United States Patent [19]

McGuigan

[11] 4,139,037

[45] Feb. 13, 1979

[54] BAG FOR COLLECTING WASTE MATERIAL

[76] Inventor: Marie McGuigan, 39 Dwelley Ave., Hanover, Mass. 02339

[21] Appl. No.: 818,519

[22] Filed: Jul. 25, 1977

[51] Int. Cl.[2] ..... B65D 33/14

[52] U.S. Cl. ..... 150/11; 150/1; 248/100

[58] Field of Search ..... 150/1, 11; 248/95, 97–101, 248/206 A

[56] References Cited

U.S. PATENT DOCUMENTS

| | | | |
|---|---|---|---|
| 269,625 | 12/1882 | Blake | 248/100 X |
| 1,872,918 | 8/1932 | Ernsberger | 248/100 |
| 2,170,710 | 8/1939 | Dalzell | 248/101 |
| 2,625,973 | 1/1953 | Weldon | 150/1 |
| 2,636,800 | 4/1953 | Downey | 150/1 X |
| 2,678,672 | 5/1954 | Spilman | 150/11 |
| 2,689,594 | 9/1954 | Wendt | 150/1 |
| 2,964,275 | 12/1960 | Atkinson | 248/206 A X |
| 3,189,728 | 6/1965 | Schneider | 248/206 A X |
| 3,322,477 | 5/1967 | Armijo | 248/101 X |
| 3,831,650 | 8/1974 | Consorti | 248/99 X |

*Primary Examiner*—Donald F. Norton
*Attorney, Agent, or Firm*—John M. Brandt

[57] ABSTRACT

A bag for collecting waste material from a cutting machine is disclosed. The bag has a closed end and an open end, the open end arranged to fit within the base of the machine from which the waste is ejected. Means for supporting the bag and means for sealing the outer surface of the bag against the inner surface of the base are included in the design as well as an optional drawstring for reducing the circumference of the open end.

4 Claims, 3 Drawing Figures

BAG FOR COLLECTING WASTE MATERIAL

BACKGROUND OF THE INVENTION

1. Field of the Invention

The invention resides in the field of waste material collectors and more particularly relates to bags which are attached to workshop tools for collecting chips and dust.

2. Description of the Prior Art

Bags for collecting waste material are well known in the prior art. However, to the best of applicant's knowledge, all prior art bags are designed to fit over rather than inside the ejecting ports of cutting machines. Other collecting apparatus such as rigid wood or metall chutes, ducts, and boxes are also known, which devices are of fixed dimension and are manufactured to fit particular machines and to remain stationary with the machine.

The present invention is presented as an improvement over the prior art in that the bag is designed to fit inside the base of a typical workshop tool, such as a saw or planar, from which waste is ejected. As such, no special ducts leading from the base to a collecting arrangement are required and the use of the bag in no way interferes with the ordinary mounting and use of the machine. Further, the bag is flexible and as such with an optional drawstring may be adjusted in size to fit a wide variety of tools.

SUMMARY OF THE INVENTION

The invention may be summarized as a waste collecting bag having an open end arranged to fit within the lower portion of the base of a waste producing cutting machine. Means are provided for supporting the bag upright, preferably from the base itself, but an auxiliary stand might also be employed.

Means for sealing the outer surface of the bag to the inner surface of the machine base are incorporated and preferably comprises magnetic tape which will be attracted to the steel from which most bases are composed.

The bag may be dimensioned to fit a particular machine or may be oversize and include a drawstring for reducng the circumference of the bag down to the inner dimensions of the base. A drawstring has the further advantage that the bag may be completely closed upon removal from the machine for transporting the waste therein for disposal without spillage.

These and other advantages and features will become more apparent from the description of the preferred embodiment and drawings which follow.

DESCRIPTION OF THE PREFERRED EMBODIMENT

Figure 1:
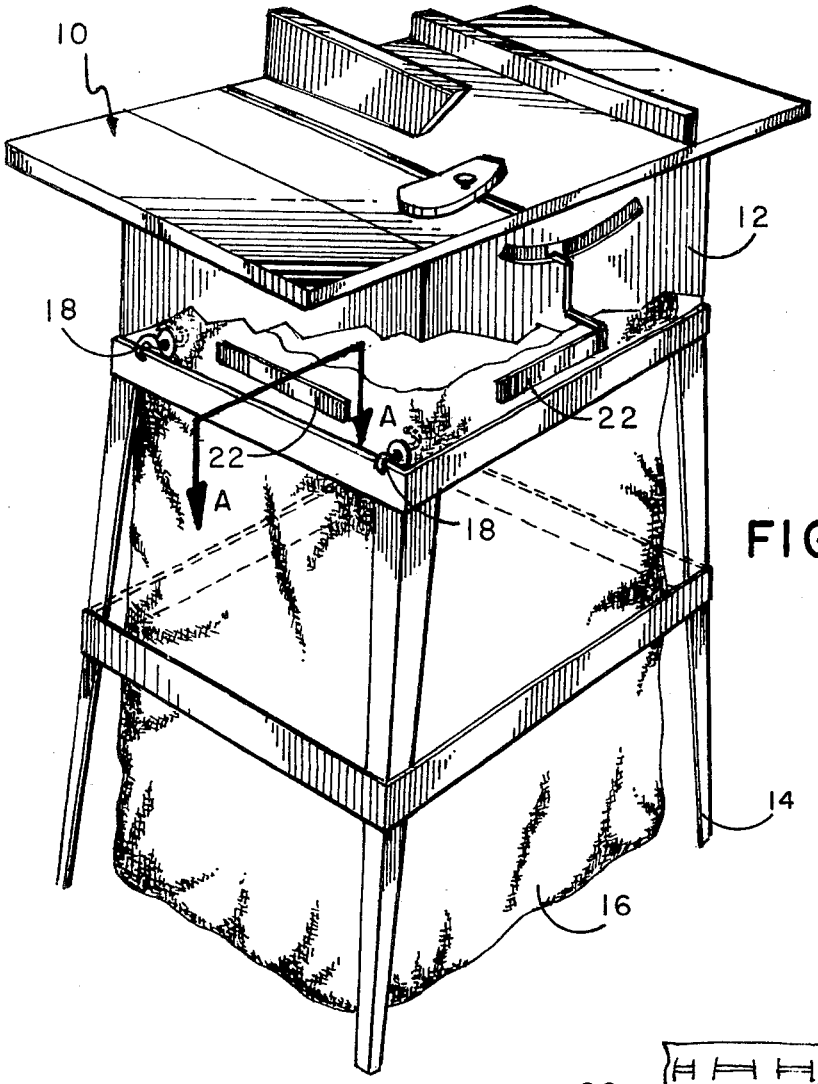
FIG. 1 is a perspective view of the invention in use.

Referring first to FIG. 1, there is shown a perspective view of the invention in use on a workshop cutting machine such as a circular saw 10 having base 12 mounted on stand 14. Bag 16 may be constructed of any convenient flexible material such as canvas or heavy grade plastic. The bag is supported from either base 10 or stand 14 by means such as hooks 18 which pass through grommets 20 positioned in the corners at the upper open end of the bag. The base is shown broken away to illustrate means 22 for sealing the surface of the bag against the inside of the base. These are preferably strips of magnetic tape but may be comprised of other material such as double faced adhesive tape or velcro, a substance manufactured, patented and trademark by American VELCRO Inc., Manchester, N.H. The strips may be attached by any convenient method such as sewing or gluing.

Figure 2:
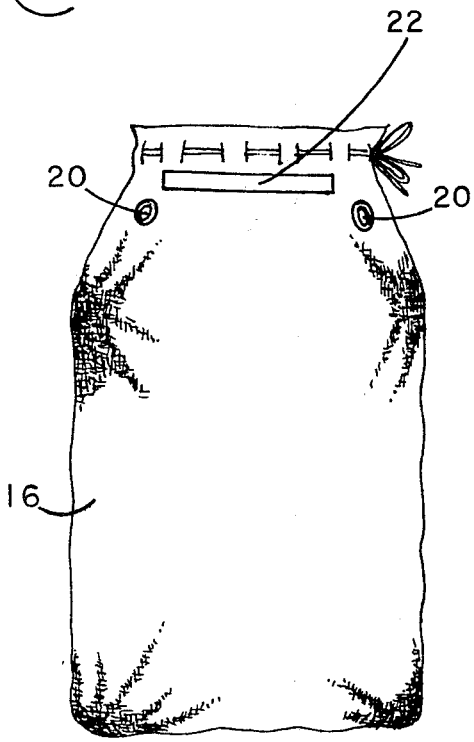
FIG. 2 is a side view of the invention.

The bag is preferably of a length such that its lower closed end is supported by the floor under the stand or a shelf on the stand itself. The upper circumference of the bag may be sized to fit inside a particular base or as shown in FIG. 2 an optional drawstring 24 may be provided to reduce the size of the open end to fit a variety of bases.

Figure 3:
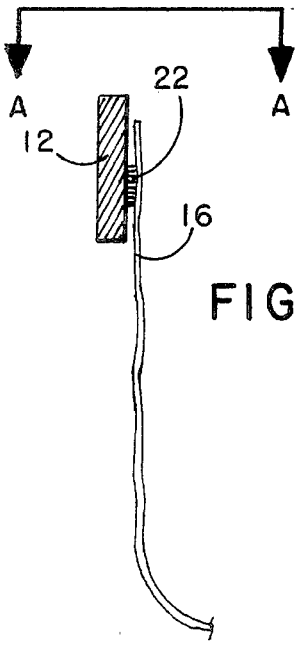
FIG. 3 is a side view of FIG. 1 along line A—A.

Referrig to FIG. 3, a side view of FIG. 1 along line A—A is shown further illustrating the positioning and use of the sealing strip to prevent spillage of chips and sawdust outside the bag.

What is claimed is:

1. Apparatus for collecting waste material from a cutting machine producing said waste material, said machine mounted on a base having an inner surface defining a port from which said waste material is ejected, said apparatus comprising in combination:

a. a bag having a closed end and an open end, said open end arranged to extend into said port, said bag further having a plurality of hook receiving holes disposed at said open end;

b. drawstring means positioned at said open end of said bag for reducing the circumference of said open end;

c. supporting means for supporting said bag comprising a plurality of hooks arranged to engage said hook receiving holes and said base; and d. sealing means for sealing a substantial portion of the outer surface of said open end of said bag against the inner surface of said base.

2. The apparatus of claim 1 wherein said sealing means comprises magnetic tape.

3. The apparatus of claim 1 wherein said sealing means comprises VELCRO.

4. The apparatus of claim 1 wherein said sealing means comprises double faced adhesive tape.

* * * * *